US007494076B1

(12) United States Patent
Larson et al.

(10) Patent No.: US 7,494,076 B1
(45) Date of Patent: Feb. 24, 2009

(54) FAST SECURE METHOD AND PRESSING MEANS FOR QUICKLY CAUSING DATA STORAGE DEVICES TO HAVE UNRECOVERABLE DATA

(76) Inventors: Mark Dennis Larson, 28011 Walnut Creek Ct., Magnolia, TX (US) 77355; Verlin Duane Larson, 28011 Walnut Creek Ct., Magnolia, TX (US) 77355

( * ) Notice: Subject to any disclaimer, the term of this patent is extended or adjusted under 35 U.S.C. 154(b) by 0 days.

(21) Appl. No.: 12/059,510

(22) Filed: Mar. 31, 2008

Related U.S. Application Data

(60) Provisional application No. 60/908,681, filed on Mar. 29, 2007.

(51) Int. Cl.
*B02C 19/00* (2006.01)

(52) U.S. Cl. ..... 241/25; 100/100; 241/101.2

(58) Field of Classification Search ..... 241/25, 241/101.2; 100/100, 177; 726/34
See application file for complete search history.

(56) References Cited

U.S. PATENT DOCUMENTS 4,881,459 A * 11/1989 Ramun ..... 100/95
5,632,199 A * 5/1997 Molitorisz et al. ..... 100/100
6,039,637 A * 3/2000 Hutchison et al. ..... 451/271
6,189,446 B1 * 2/2001 Olliges et al. ..... 101/6
6,685,119 B2 * 2/2004 Castronovo ..... 241/260.1
6,910,650 B1 * 6/2005 Siegelman ..... 241/168
7,089,852 B2 * 8/2006 Iacobucci ..... 100/100
7,099,110 B2 8/2006 Detzler
7,263,190 B1 * 8/2007 Moritz ..... 380/258
2008/0250948 A1 * 10/2008 Aoki et al. ..... 100/282

OTHER PUBLICATIONS http://www.firstchoicedestruction.com/harddrivedestruction.html.

* cited by examiner

*Primary Examiner*—Mark Rosenbaum
(74) *Attorney, Agent, or Firm*—Buskop Law Group, PC; Wendy Buskop

(57) ABSTRACT

A secured method and pressing means for rendering data stored on a plurality of data storage devices unrecoverable. The method begins in a secure room where a mobile, relocatable hydraulic pressing means including at least one beveled bar is used for holding and crushing the plurality of data storage devices simultaneously. An activation device is connected to the mobile relocatable hydraulic pressing means enabling a user to send a signal to commence the destruction of the data storage devices to form debris. The debris is packed into storage containers and transported in a secure transport device to a location for secure storage or final disposition.

14 Claims, 4 Drawing Sheets

FAST SECURE METHOD AND PRESSING MEANS FOR QUICKLY CAUSING DATA STORAGE DEVICES TO HAVE UNRECOVERABLE DATA

CROSS-REFERENCE RELATED APPLICATIONS

This non-provisional patent application claims benefit to Provisional Patent Application No. 60/908,681, which was filed Mar. 29, 2007. The Provisional Patent Application is incorporated by reference herein.

FIELD

The present embodiments relate generally to a method for rendering data stored on a plurality of data storage devices unrecoverable.

BACKGROUND

One of the fastest growing crimes in the United States is now 'identity theft'. Virtually unheard of 5 years ago, this technical crime relies on the easy access of information such as social security numbers, credit card numbers, bank statements, etc. on a computer's hard drive or other data storage device.

With personal computers now reaching near saturation levels, much of this type of information is now stored in personal computers, which offer little or no protection of this data. In addition, the proliferation of digital devices such as cameras, and digital communication such as email, mean that more and more personal information, as well as accounting information is now stored on the average home computer. So prevalent is digital storage that virtually every search warrant executed now results in the removal of all personal computers from the target residence or business. In most cases with little or no effort, this information becomes available to law enforcement or worse, to a party with criminal intent.

In many cases, users of personal computers may have no idea of the data that is contained on their hard drive. Because of caching programs and use of 'cookies', it is possible that pieces of various web pages, including unintended popup-ads, etc. may be stored in 'temporary' areas. Users have little control over this data and it may contain text and images that do not pertain to their normal use of the Internet. Under legal scrutiny such materials may be potentially damaging.

Businesses have recognized the importance of data security for many years but recognition of the problem has not resulted in many viable solutions for keeping data away from intruders. Currently, businesses protect data using firewall technology and internal security profiles which act as electronic gatekeepers, insuring that only authorized parties have access to specific information. If employed correctly, such technologies can be effective but it is rarely employed correctly. On a daily basis, newspapers run stories of information being stolen, published or destroyed. In some cases the perpetrator is external but it is just as often an existing employee or another person with internal access.

Improper disposal of data assets is a missing security link for many companies. A recent computer industry journal reported that a sample test of personal computers resold on one of the largest online public actions had a very large percentage of about 70 percent of personal data, including corporate and web surfing images.

Governments and military organizations should have the greatest need for data security, yet they appear to be no better, or possibly worse prepared than corporations. The recent story of missing notebook computers from limited access facilities indicates that these organizations suffer many of the same problems as corporations, only with data involving national security. Although the existence of leading edge 'secret' technology is a possibility at certain governmental levels and installations, for the most part the vast majority of governmental data is stored on the same type of systems used by major corporations.

A recent invention is the development of 'data eraser' software, which is intended to make deleted files 'unrecoverable' as well as eliminate the extraneous data that is created and stored by many applications, especially those involving the Internet. The efficacy of these products vary, and although some are capable of removing specific files to a point that they cannot be recovered, most are cumbersome and time consuming to use for the average computer user. Moreover, such programs must first be initiated, time does not always permit initiation. The computer may not remember to initiate the program and further, the program must have time to run and perform its functions.

There exists a need for a device and method for quickly destroying, generally instantaneously and without significant user intervention, data contained on a storage medium, such as a hard drive, upon command or some pre-determined trigger event.

The present embodiments meet these needs.

BRIEF DESCRIPTION OF THE DRAWINGS

The detailed description will be better understood in conjunction with the accompanying drawings as follows.

Figure 1:
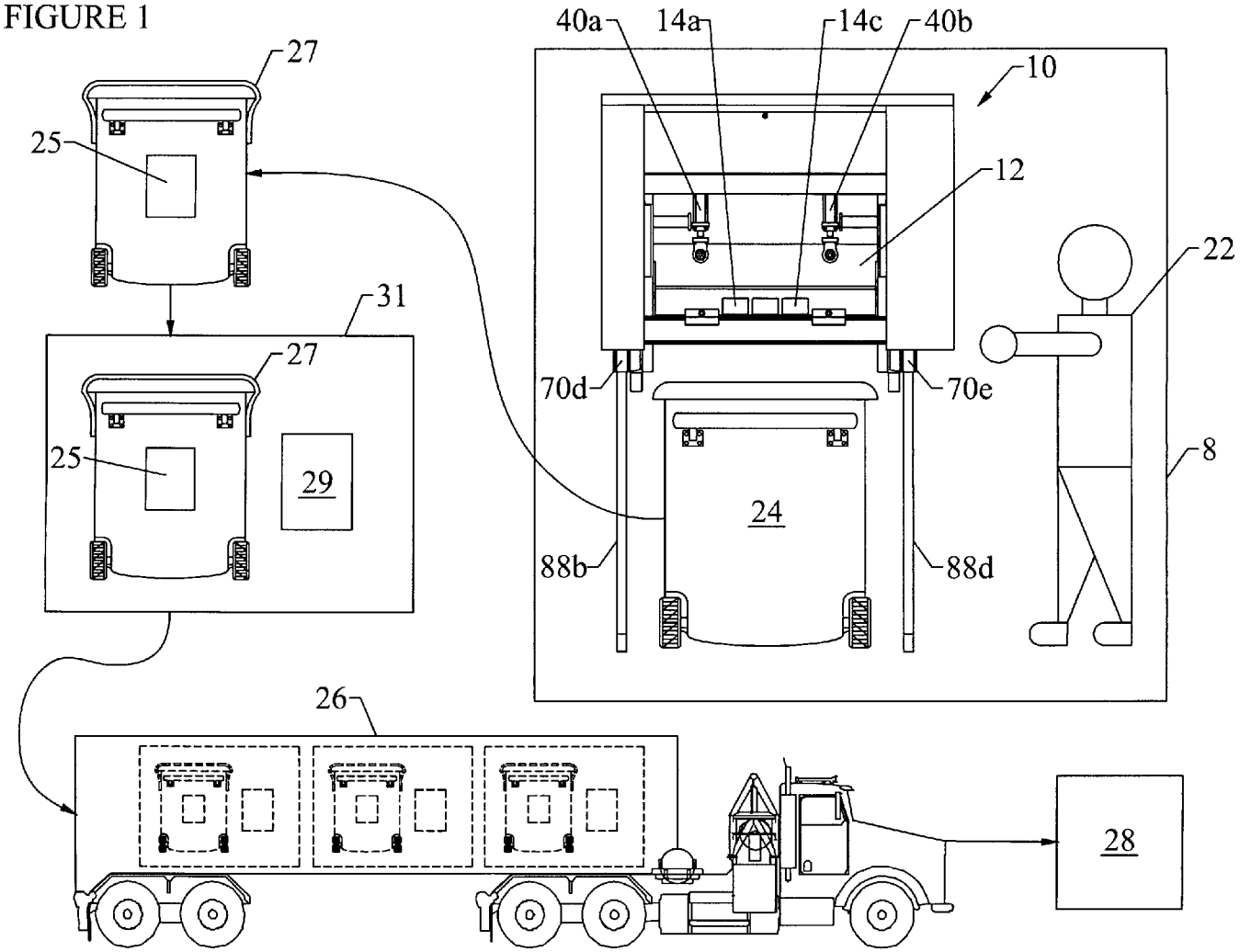
FIG. 1 depicts a schematic of the system usable with the embodiments of the method.

The present embodiments are detailed below with reference to the listed Figures.

DETAILED DESCRIPTION OF THE EMBODIMENTS

Before explaining the present embodiments in detail, it is to be understood that the embodiments are not limited to the particular embodiments and that they can be practiced or carried out in various ways.

One of the benefits of the present embodiment is the capability to perform onsite destruction that is integral to ensuring the integrity of the data until final disposition can be decided. By performing onsite destruction it would be possible to ensure the custody and control of data, this is also regarded as a chain of custody.

The chain of custody of data involves detailing the location and possession of the data at all times.

By performing onsite destruction the client would be able to actually visually see the destruction of the data. In addition the onsite destruction would render the data unreadable by conventional means.

The present embodiment relates to a secured method for rendering data stored on a plurality of data storage devices unrecoverable, to be compliant with state and federal laws, local regulations, and company policy and procedures. For example, the present embodiments are HIPPA compliant. The type of data storage devices that are destroyed include 3.5° hard disks, 1.5° hard disks, other size hard disks, flash drives, mobile phones, MP3 players, CD Rom disks, phones, and credit card machines. Other regulations that the present embodiments can be compliant with include Sarbanes Oxley, Gramm-Leach-Bliley, Fair Credit reporting Act, Children's Online Privacy Act, FTC consumer, Texas Business and Commerce code chapter 48 and other similar regulatory sections. The embodiments of the invention are also compliant with other regulations on a local, state, nation, and worldwide level.

The embodiments of the invention generally relate to a fast secure method for rendering data stored on a plurality of data storage devices physically unrecoverable. The embodiments of the invention contemplate that the data stored on the data storage devices can be rendered unrecoverable at a user site. A user site can be a bank, a law office, an accounting office, governmental agency offices, a doctors office, a hospital, an insurance company, or another office or location requiring confidential information to be stored on electronic mediums.

The embodiments of the method involve using a secure room. A secure room can be a room where access is restricted.

The method also involves using a mobile relocatable hydraulic pressing means. The portable mobile relocatable hydraulic pressing means can have at least one beveled bar for crushing the plurality of data storage devices simultaneously.

The portable mobile relocatable hydraulic pressing means can also have an activation device, used to control the movement of the beveled bar. When the activation means is operated to allow the beveled bar to move towards the data storage devices the beveled bar will engage the data devices.

When the data storage devices are engaged the beveled bar will physically destruct the data storage devices. When the plurality of data storage devices are physically destroyed unusable debris is formed. The present embodiments of the method can be capable of forming unusable debris at a rate of at least 500 data storage devices per hour.

The hydraulic pressing means can be a hydraulic ram press adapted to apply pressure in a range from about 1,000 psi to about 14,000 psi at the beveled bar. In an embodiment the pressure can be higher if desired.

The method can further include packing unusable debris into a repository container. The repository container can be a crate, a box, or a similar storage apparatus. Once the repository container is filled with the unusable debris the repository container can be labeled with a scannable label using a tamper proof seal.

The tamper proof seal can be achieved by positioning the scannable label on the container so that the scannable label will be physically altered if the tamper proof seal is broken or otherwise manipulated. The scannable label can be an RFID tag, a bar code, a biometric tag, a smart chip, or similar devices, or combinations thereof.

It is contemplated that the tamper proof seal can include using a lock, such as a pad-lock on the sealable container and applying tamper proof tape to the seal.

Upon accomplishing the tamper proof seal the repository container can be associated with a set of custody control forms. The custody control forms would be signed each time there was a transfer of control of the repository container. In an embodiment of the method the custody control forms can require a signature or name of the transferee and transferor; indicate the time of transfer, indicate the location of the transfer, and indicate the date of transfer. The control forms can be used to provide a secure custody transfer of the custodial sealed unusable debris from destruction to a location for secure storage or final disposition of the debris.

It is contemplated that the custody control forms would be such that they comply with the Department of Defense 5220.22M standards of January 1995, which is incorporated by reference herein in its entirety.

The method can also involve the step of transporting the custodial sealed unusable debris in a secure transport device to a location for secure storage. The secured storage could be a location that is proximate to the secured room, a landfill, or another location where further actions can be taken on the custodial sealed unusable debris.

The locations where further actions can be taken can be a smelting facility, where the unusable debris would be smelted into a billet. Another possible location for further actions can be a shredding facility, where the unusable debris would be shredded to resemble confetti.

It is contemplated that in an embodiment the operator can be a customer, for example the operator can be an executive at a banking institution, or another employee that has the authority to handle confidential information. The operator can be properly training to ensure the safe use of the mobile relocatable pressing means.

In the alternative the operator can be a service provider who would create the unusable debris, seal the unusable debris, transport the unusable debris, and store the unusable debris. The unusable debris can be stored until final disposition can be arranged.

In an embodiment of the method the step of transporting the sealed debris can further include the step of checking for tampering with the debris after a preset period of time.

The embodiments of the invention further relate to a relocatable hydraulic pressing means usable with the embodiments of the method. The relocatable hydraulic pressing means can have at least one joist. The relocatable hydraulic pressing means can also include a first vertical beam connected to one side of the joist and a second vertical beam connected on a side of the joist opposite the first vertical beam.

The present embodiments of the hydraulic pressing means can further include at least one hydraulic cylinder with a ram affixed to the at least one joist.

The hydraulic cylinder can engage at least one moveable beveled bar disposed between the first and second vertical beam. The moveable bevel bar can also be positioned below the at least one joist. The hydraulic cylinder can engage the moveable beveled bar such that it is capable of moving the bar towards the destruction zone and away from the destruction zone.

The hydraulic cylinder can be connected to an actuation device. The actuation device can send a signal that causes the beveled bar to move towards the destruction zone and away from the destruction zone.

The data storage devices are disposed upon a destruction zone. The destruction zone can have a first and second bar. The first bar is connected to the first vertical beam. The second bar is connected to the second vertical beam.

The first and second bars can create a gap. The gap can be sized to enable the moveable beveled bar to physically disable data storage devices disposed on the two bars. As the moveable beveled bar engages the data storage devices the data storage devices are destroyed as the moveable beveled bar traverses through the gap.

The mobile relocatable hydraulic pressing means can have a power system, which can have an electric motor and a hydraulic pump connected to a hydraulic supply tank, for powering the hydraulic cylinder. When the power system is activated by the actuator the hydraulic cylinder will either extend moving the moveable beveled bar towards the data storage device, or retreat the movable beveled bar from the destruction zone.

In an embodiment of the relocatable hydraulic pressing means, a plurality of joists can be used to support the movable beveled bar. For example it has been found beneficial, but not necessary, to have three joists supporting the moveable beveled bar. The three joist arrangement ensures that the pressing force is directed perpendicularly through the data storage devices and that the movable beveled bar is adequately supported. For example if a moment is created it can cause the movable beveled bar to twist, however with the three joist arrangement the moment will be adequately resisted.

A plurality of guides can be secured to each end of the vertical beams to ensure the moveable beveled bar remains centered over the destruction zone. The spacers can be about ½ inch outside diameter cylindrical segments.

The at least one joist, the first vertical beam, the second vertical beam, the beveled bar, and destruction zone can be adapted to be supported by at least four adjustable hydraulic legs. The adjustable hydraulic legs can be adjusted by the hydraulic power system.

A wheel can be removabley secured next to each adjustable hydraulic leg. The wheel will allow the mobile relocatable hydraulic pressing means to be transported from one location to another location. The removable wheels can be removed when the adjustable hydraulic legs are fully extended.

The embodiments of the invention can be better understood with reference to the figures.

Referring now to FIG. 1, which depicts a schematic for an embodiment of the system usable with the present invention. The depicted embodiment is depicted having a secure room 8 with a mobile relocatable hydraulic pressing means 10 that has a beveled bar 12 for crushing the plurality of data storage devices 14*a*-14*c* simultaneously. An operator 22 can activate the relocatable hydraulic pressing means 10 to crush the plurality of data storage devices. A first hydraulic cylinder 40*a* and a second hydraulic 40*b* cylinder will move the beveled bar 12, upon activation of the relocatable hydraulic pressing means 10.

A repository container 24 can be placed under the relocatable pressing means 10. Four adjustable hydraulic legs can be adjusted to accommodate the repository container 24. Two hydraulic adjustable legs 88*b* and 88*d* are depicted in FIG. 1. Adjustable hydraulic legs 88*b* and 88*d* are supported by a fourth leg support 70*d* and a fifth leg support 70*e* respectively. The leg supports can be best understood with reference to FIG. 3.

The debris can be packed into the repository container 24. The repository container 24 can be a crate or storage container built out of wood, cement, or steel, additional storage containers and types can be used. The repository container 24 is labeled with a scannable label 25, such as a bar code, a RFID, or a biometric tag, a smart chip, or a similar device. The label is applied to create a tamper proof seal 27, for example tamper proof tape can be placed on the container so that it will indicate if the seal is broken.

The sealed repository container is connected with or associated with a custody control form 29 forming a custodial sealed unusable debris 31. The custodial sealed unusable debris can be transported in a secure transport device 26 to a location 28 for secure storage or final disposition. The secure transport device 26 can be a truck, van, or other similar transport device. The location for secure storage can be a warehouse, a room proximate to the secure room, a land fill, or a similar location.

Figure 2:
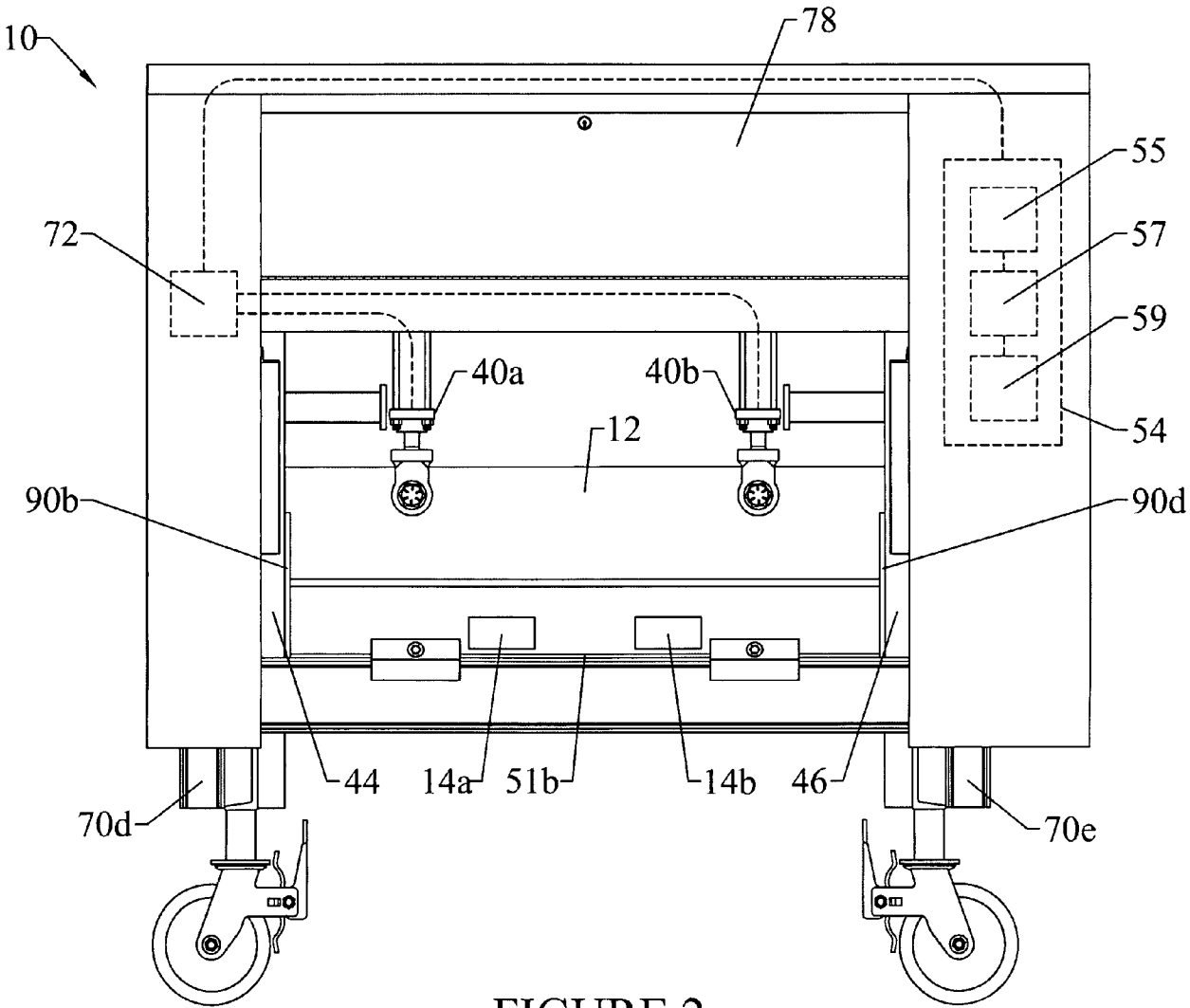
FIG. 2 depicts an embodiment of the relocatable hydraulic pressing means which is usable with the embodiments of the method.

FIG. 2 depicts an embodiment of the relocatable hydraulic pressing means 10. The moveable beveled bar 12 is connected and disposed below the first cylinder 40*a* and the second cylinder 40*b*. The first cylinder 40*a* and second cylinder 40*b* can be dual stroke hydraulic cylinders, such as 200811TC2], Manufactured by CHIEF.

The beveled bar 12 is disposed between a first vertical beam 44 and a second vertical beam 46. The data storage devices 14*a* and 14*b* reside on a first bar 51*a*, not depicted in FIG. 2, and second bar 51*b*.

A hydraulic power system 54 is connected to a hydraulic splitter 72 and can be used to ensure that equal hydraulic fluid is supplied to the first cylinder 40*a* and second cylinder 40*b*. The cylinders 40*a* and 40*b* move the moveable beveled bar 12 downward to destroy the data storage devices 14*a* and 14*b* placed on the first bar and second bar.

The hydraulic power system 54 has a hydraulic pump 57 for pumping fluid from a hydraulic supply tank 59 to the hydraulic cylinder 40*a* and 40*b*. The hydraulic pump should be capable of producing at least 100 psi. A exemplary hydraulic pump can produce 2,000 psi or more. An example of the power system 54 is manufactured by Fenner Stone Manufactures, part number PPMC17C2P4VXXX.

Guides 90*b* and 90*d* are depicted in FIG. 2 for guiding the beveled bar 12 as it moves towards and away from the first bar 51*a* and the second bar 51*b*. The hydraulic pump 57 can be powered by an electric motor 55. The electric motor can be activated by an electric switch.

Figure 3:
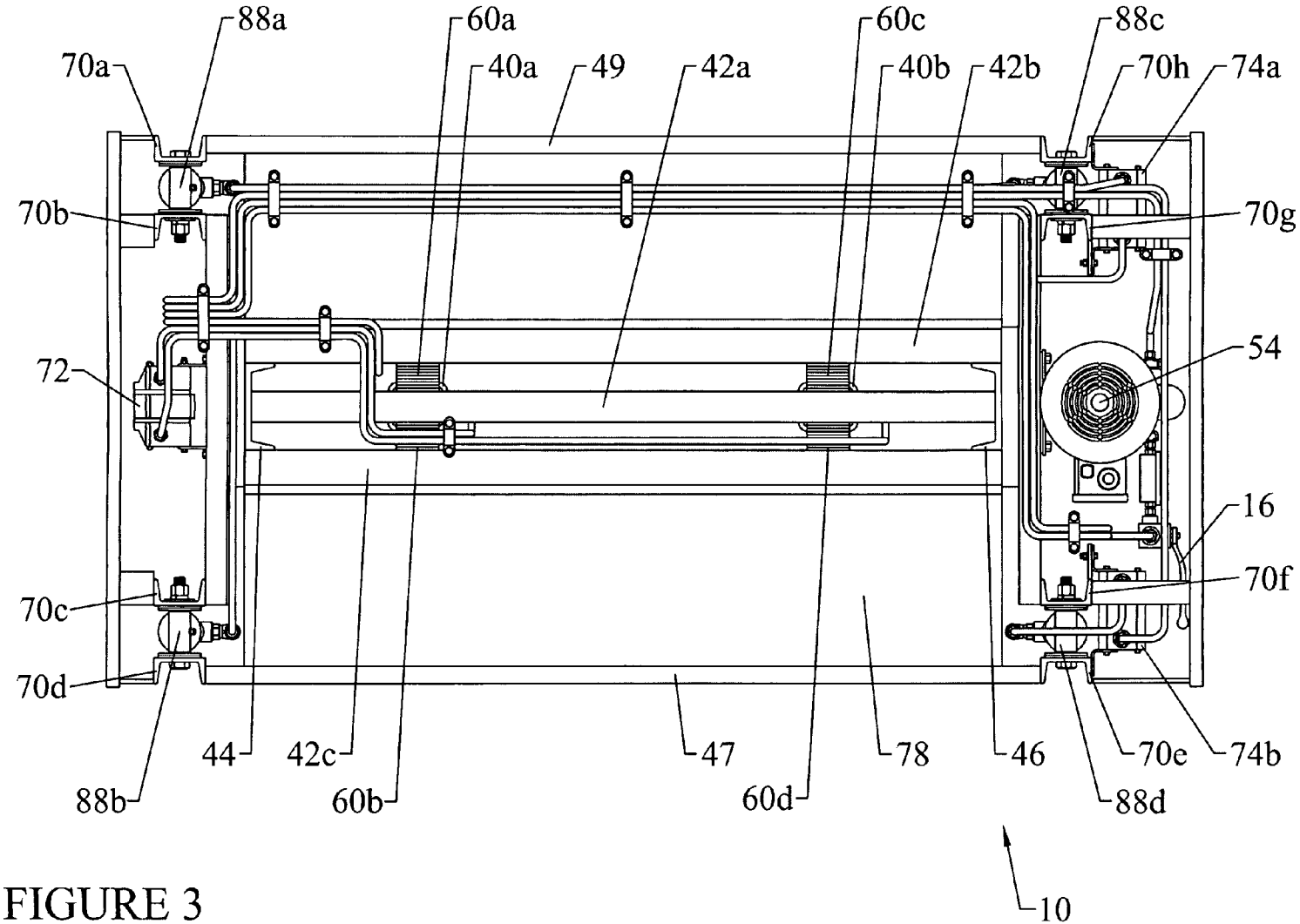
FIG. 3 depicts a top view of the embodiment of the hydraulic pressing means depicted in FIG. 2.

The pressure and fluid flow to control the beveled bar 12 and the support legs 88*a* 88*b* 88*c* and 88, can be switched and directed by the activation device 16, which can be a ball valve and lever, shown in FIG. 3. The activation device 16 can be operated to act on a valve assembly. The valve assemblies can be purchased from Walvoil™, part number sd5/1P9KG3) 28L-AET-SAE.

As shown in FIG. 2, the adjustable hydraulic legs 88*b* and 88*d* are depicted in a lowered position, supported by leg supports 70*d* and 70*e*.

Figure 4:
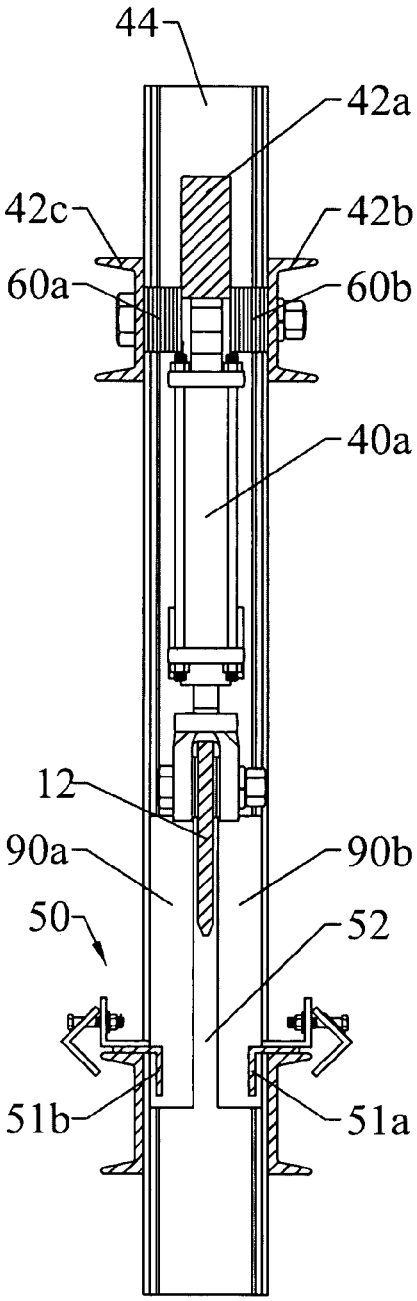
FIG. 4 depicts a detailed view of cut view of the joists.
Figure 5:
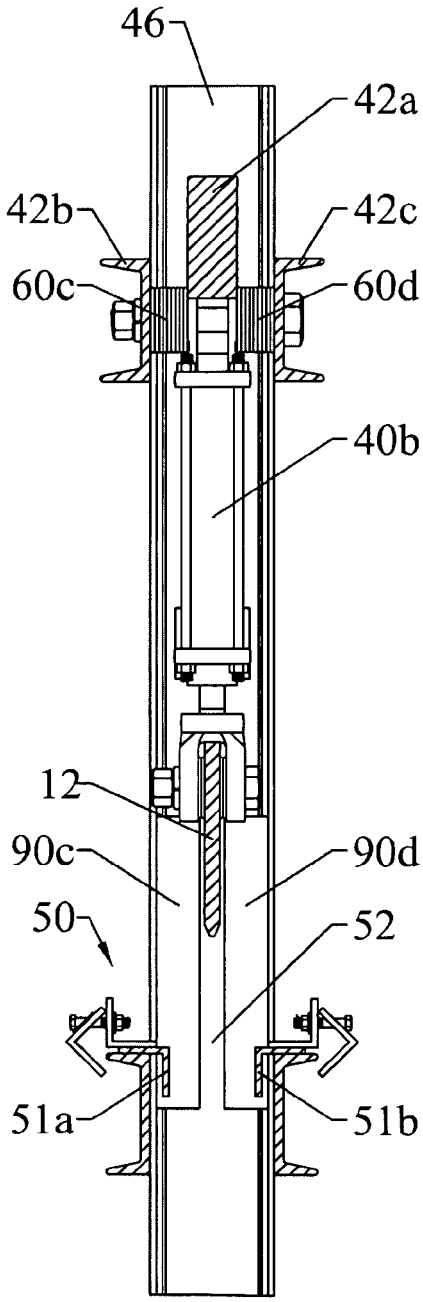
FIG. 5 depicts a detailed view of an embodiment of the joists.

Referring now to FIG. 3, FIG. 4, and FIG. 5. A first joist 42*a*, a second joist 42*b*, and a third joist 42*c* are connected to the first vertical beam 44 and second vertical beam 46. The vertical beams can be approximately 48 inches long.

A first hydraulic adjustable leg 88*a* is supported by a first leg support 70*a* and a second leg support 70*b*. A second hydraulic adjustable leg 88*b* is supported by a third leg support 70*c* and a fourth leg support 70*d*. A third hydraulic adjustable leg 88*c* is supported by an eighth leg support 70*h* and a seventh leg support 70*g*. A fourth hydraulic adjustable leg 88*d* is supported by a fifth leg support 70*e* and a sixth leg support 70*f*.

The hydraulic adjustable legs can be used to increase the height of the pressing means 10 so that a repository container 24, as depicted in FIG. 1, can be placed underneath to catch the destroyed data storage devices. The hydraulic adjustable legs can be cylinders having a diameter of about 2 inches by 36 inches. An example of such cylinders are cylinders manufactured by CHIEF™, part number 203612WP, 2 inches by 36 inches. It is contemplated that the hydraulic adjustable legs are in selective communication with the hydraulic power system 54. A first hydraulic leg splitter 74*a* and a second hydraulic leg splitter 74*b* are in fluid communication with the hydraulic power system 54. The hydraulic leg splitters 74*a* and 74*b* ensure equal hydraulic fluid distribution between the adjustable hydraulic legs. The hydraulic leg splitters 74*a* and 74*b* can be cut off from communication with the hydraulic power system by the adjustment of a butterfly valve. Activation device 16 can be used to adjust the hydraulic legs and the beveled bar 12.

The hydraulic splitter 72 is depicted in fluid communication with the hydraulic power system 54 and the first cylinder 40*a* and second cylinder 40*b*. a first horizontal support beam 47 is secured to the fifth leg support 70*e* and the fourth leg support 70*d*. A second horizontal support beam 49 is depicted secured to the first leg support 70*a* and the eighth leg support 70*h*. The leg supports and the support beams can be steel C-channel, I-beams, or square stock. A cabinet 78, which can be better seen in FIG. 2, can be used to store tools or other items is depicted disposed between the fourth adjustable hydraulic leg 88*d* and the second adjustable hydraulic leg 88*b*. The horizontal support beams can be approximately 32 inches long.

The horizontal support beams and the vertical support beams can be sized to fit through standard door frames. A first plurality of spacers 60*a* and a third plurality of spacers 60*c* are depicted disposed between the first joist 42*a* and the second joist 42*b*. A second plurality of spacers 60*b* and a fourth plurality of spacers 60*d* are disposed between the first joist 42*a* and the third joist 42*c*. The plurality of spacers can range from one spacer to 10 spacers, depending on the width of the gap 52. The spacers can be washers, custom made elastic spacers, or similar spacing mechanisms.

A first guide 90*a* is depicted secured to the vertical beam 44 on one side of the beveled bar 12 and a second guide 90*b* is secured to the vertical beam 44 on the other side of the beveled bar 12. A third guide 90*c* is secured to the second vertical beam 46 on one side of the beveled bar 12. A fourth guide 90*d* is depicted secured on the second vertical beam 46 on the side of the beveled bar opposite the third guide 90*c*.

The beveled bar 12 is aligned with gap 52. The gap 52 is formed between the first bar 51*a* and the second bar 51*b*. The gap 52, the first bar 51*a*, and the second bar 51*b* form the destruction zone 50.

While these embodiments have been described with emphasis on the embodiments, it should be understood that within the scope of the appended claims, the embodiments might be practiced other than as specifically described herein.

What is claimed is:

1. A fast secure method for rendering data stored on a plurality of data storage devices physically unrecoverable at a user site, the method comprising:

using a secure room;

crushing a plurality of data storage devices using a mobile relocatable hydraulic pressing means comprising at least one beveled bar forming unusable debris in the secure room;

packing unusable debris into a repository container;

labeling the repository container with a scannable label using a tamper proof seal;

connecting the repository container with custody control forms forming custodial sealed unusable debris; and transporting the custodial sealed unusable debris in a secure transport device to a location for secure storage.

2. The method of claim 1, wherein the hydraulic pressing means is operated by an operator, and wherein the operator is a customer or a vendor of the customer.

3. The method of claim 1, wherein the step of transporting the sealed debris further comprises the step of checking for tampering with the debris after a preset period of time.

4. The method of claim 1, wherein the hydraulic pressing means is a hydraulic ram press adapted to apply pressure in a range from about 1,000 psi to about 14,000 psi.

5. The method of claim 1, further comprising completing the method according to Department of Defense 5220.22M standards of January 1995.

6. The method of claim 1, wherein the secured room is at a customer's location.

7. The method of claim 1, further comprising indicating with the custody control forms a chain of custody for the sealed debris, wherein the custody control forms comprise names of the transferor and transferee, locations of transfer, and dates of transfer at each transfer point.

8. The method of claim 1, wherein the unusable debris are formed at a rate of at least 500 data storage devices per hour.

9. The method of claim 1, further comprising final disposition of the debris.

10. The method of claim 9, wherein the final disposition comprises further destroying the custodial sealed unusable debris by shredding, to resemble confetti, at a remote location.

11. The method of claim 1, further comprising smelting the custodial sealed unusable debris to a billet at a remote location, shredding the unusable debris at a remote location, or the use of a landfill for final disposition of the unusable debris.

12. The method of claim 1, wherein the scannable label is an RFID tag, a bar code, a biometric tag, a smart chip, or similar device.

13. The method of claim 1, wherein the tamper proof seal comprises a sealable container with a lock and a tamper proof tape.

14. The method of claim 1, wherein the custody control forms provide a secure custody transfer of the custodial sealed unusable debris from pressing to the location for secure storage.

* * * * *